United States Patent [19]

Lieberman

[11] Patent Number: 4,914,842

[45] Date of Patent: Apr. 10, 1990

[54] LAMINATED FRAME ASSEMBLY AND METHOD FOR USING SAME

[76] Inventor: Aaron Lieberman, 1945 Callowhill St., Philadelphia, Pa. 19130

[21] Appl. No.: 238,489

[22] Filed: Aug. 30, 1988

[51] Int. Cl.[4] ..... B44C 5/02

[52] U.S. Cl. ..... 40/158.1; 156/249; 428/14; 428/41

[58] Field of Search ..... 40/158.1, 159; 428/14, 428/41, 46; 156/108, 249, 263

[56] References Cited

U.S. PATENT DOCUMENTS

| | | | |
|---|---|---|---|
| 3,341,961 | 9/1967 | Shanks | 40/158.1 |
| 4,019,943 | 4/1977 | Holson | 40/158.1 |
| 4,231,833 | 11/1980 | Lieberman | 428/14 |
| 4,332,095 | 6/1982 | Tanney | 40/158.1 |

*Primary Examiner*—Cary E. Stone
*Attorney, Agent, or Firm*—Louis Weinstein

[57] ABSTRACT

Framing apparatus for framing snap shots and the like, including a flexible rectangular-shaped transparent sheet having an opaque frame printed about its perimeter. A pressure sensitive adhesive coating is coextensive with the aforementioned opaque frame. A transparent sheet of much thinner gauge than the first-mentioned sheet is releasably secured to the pressure sensitive adhesive coating. The unassembled frame is moved about the snap shot or picture to be framed. The transparent nature of the assembly facilitates viewing of the picture therebeneath, enabling the user to select any portion of the picture. A writing instrument may be employed to form an outline of the frame on the picture, or the thin gauge cover sheet may be removed and the photograph pressed against the heavy plastic sheet. The portion of the picture extending beyond the frame is cut away from the part of the picture being framed. The heavy gauge flexible sheet serves as an excellent guide for cutting the photograph about the frame without any danger of damaging the frame. When the picture is cut out before mounting, the thin gauge cover sheet is then removed and the photograph pressed against the heavy gauge plastic sheet. The opaque frame conceals the possible rough edged perimeter of the photograph providing a nicely finished laminated photograph and frame assembly. An alternative embodiment provides a foldable flexible transparent sheet for mounting and framing plural graphic material in a back-to-back fashion.

28 Claims, 3 Drawing Sheets

FIG. 1
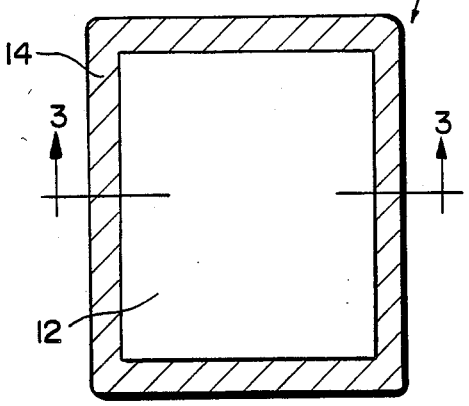
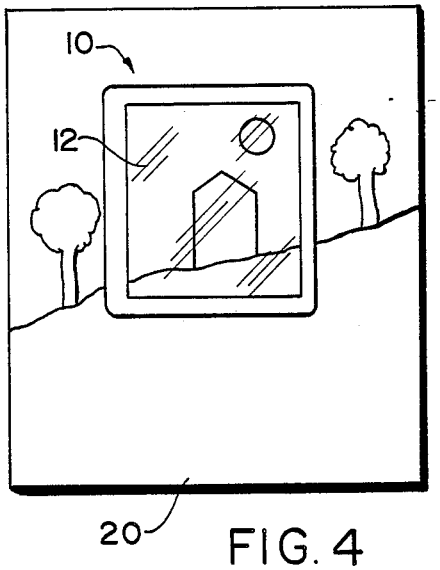
FIG. 4
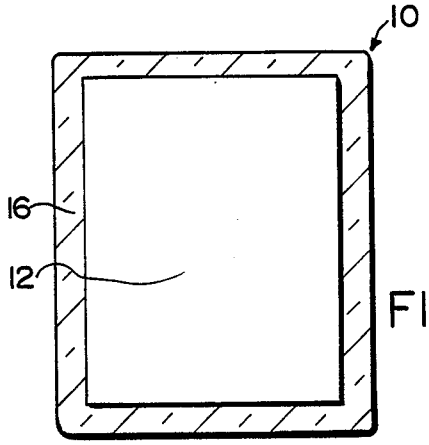
FIG. 2
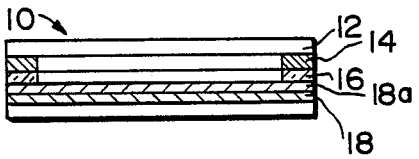
FIG. 3
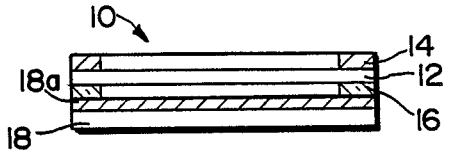
FIG. 3A 30
32
32a
34
36
36b
38
40
42
44
46
46a
48
48a
7
P1
P2
P3

LAMINATED FRAME ASSEMBLY AND METHOD FOR USING SAME

FIELD OF THE INVENTION

The present invention relates to framing assemblies for framing photographs and more particularly to a novel method and apparatus for framing a picture, photograph or other graphics or printed matter in which the framing member serves as a template or guide for selecting the desired portion of the picture and further as a guide for cutting out the desired portion of the picture without dismantling the frame.

BACKGROUND OF THE INVENTION

It is well known to employ protective sheets or envelopes for receiving and enclosing photographs, cards and the like to protect such photographs, cards and the like from being damaged or soiled due to normal handling. Such protective sheets or envelopes are specifically of a size to facilitate their insertion into a shirt pocket, wallet, pocketbook, lady's handbag or the like. Such protective envelopes are typically comprised of at least one transparent surface to facilitate unobstructed viewing of the card or picture without removal from the envelope. Such envelopes may, for example, be comprised of sheets bearing a suitable adhesive to permanently seal the picture or card there between in order to both preserve and protect the card. Such laminated structures typically comprise a pair of plastic sheets each having an adhesive layer and a release sheet covering the adhesive surface. The release sheets are removed when lamination is desired, and the item is aligned between the adhesive layers, the portions of the adhesive extending beyond the perimeter of the item being pressed together to form an adhesive seal about the item as well as joining the two protective sheets forming the protective envelope.

If desired, adhesive maybe omitted from one of the two sheets. The prior art techniques pose the disadvantages that, upon removal of the release sheet, the exposed adhesive complicates manipulation of the items to be mounted on the sheets to be joined. In addition, the exposed adhesive complicates handling of the sheets.

Frames and laminates known to the field include those set forth in U.S. Pat. Nos. 2,283,026; 2,942,368; 2,984,922; 3,024,553; 3,184,873; 3,341,961; 3,505,140 and 4,231,833. The framing assembly of U.S. Pat. No. 3,505,140 discloses a pair of hingedly connected transparent sheets having opposing pressure sensitive adhesive surfaces which are separated by a single release sheet. One of the transparent sheets may be provided with a decorative border. Such units require exposure of both adhesive surfaces, complicating the manipulation of the unit and contributing to misalignment of the picture laminated there between.

U.S. Pat. No. 4,231,833 discloses the use of the central part of a release sheet as a template which requires exposure of the adhesive surface provided upon the framing member in order to select a desired portion of the picture. Other disadvantages reside in the fact that the actual frame is not employed to provide the user with a clear picture of the end result of the framing operation. In addition, the placement of the picture upon the adhesive surface of the frame is at least as complicated as other prior art framing assemblies, thus leading to misalignment of the picture within the frame.

In addition, the framing assembly of U.S. Pat. No. 4,231,833 provides a diminished transparency quality due to the adhesive coating provided upon the transparent sheet.

BRIEF DESCRIPTION OF THE INVENTION

The present invention overcomes the disadvantages of known framing assemblies described hereinabove and is characterized by comprising a transparent framing sheet preferably having a narrow, opaque frame printed or otherwise formed about the perimeter of the framing sheet. The frame may be formed on either major surface of the framing sheet. A pressure sensitive adhesive layer is formed on one major surface of the transparent framing sheet and preferably directly upon the frame printed thereon. The adhesive surface has a border-like configuration and is coextensive with the frame printed upon the transparent framing sheet, so that the central portion of the transparent framing sheet surrounded by the frame is free of any coating whatsoever, ahesive or otherwise.

A very thin gauge release sheet, preferably dimensionally coextensive with the transparent framing sheet, has a release agent on one surface thereof, which surface is applied against the surface of the framing sheet containing the pressure sensitive adhesive to protect the adhesive layer. The release sheet is easily removable from the framing sheet in order to expose the pressure sensitive adhesive when it is appropriate to do so. The protective sheet is preferably transparent to facilitate use of the frame assembly in the preliminary framing operation.

With the framing assembly intact, the assembly is moved over the picture or photograph to any position desired. When the framing assembly is positioned in the desired location, the release sheet can be removed and the frame pressed into place on the picture or an outline of the frame can be traced upon the sheet containing the picture to be framed. The desired portion of the picture may be cut out by employing the framing assembly, which is formed of a plastic material of a toughness and gauge sufficient to prevent cutting of the framing sheet by a scissors, for example. When the desired portion of the picture is cut away before being mounted upon the frame, the release sheet is removed and the edges of the picture are coaligned with the edges of the framing sheet and the picture and transparent framing sheet are pressed together, completing the assembly. No backing sheet is required and the release sheet may be discarded. Excellent viewing of the picture is made possible due to the use of a framing sheet having excellent transparency and further due to the absence of any adhesive or other coating over the total viewing area of the picture which would otherwise degrade the transparency of the sheet. The printed frame provided on the framing sheet conceals any rough edges of the picture joined to the framing sheet as well as providing an aesthetically pleasing decorative border. The printed frame also reduces the thickness of the completed lamination. The significantly reduced adhesive bearing surface area greatly facilitates mounting of the picture to the framing sheet while at the same time providing adequate adhesive strength for adhering the picture to the framing sheet. In another alternative embodiment, the release sheet may be formed of a translucent or opaque material. In such case, the framing sheet may be placed upon the picture with the adhesive bearing surface remote from the picture and the frame may be removed either by gripping the edges of the frame or touching the frame in a region devoid of the adhesive layer and the picture may be cut out in manner similiar to that described hereinabove wherein the manipulation of the framing sheet and picture and the cutting operations are greatly simplified.

In another preferred embodiment, the flexible transparent sheet is foldable to provide a pair of frame assemblies arranged in back-to-back fashion, said flexible sheet including a third panel hingedly coupled to one of said pair of panels and foldable between said pair of panels. Adhesive layers on opposite sides of the third panel adheres the framing assemblies and maintains them in back-to-back fashion.

OBJECTS OF THE INVENTION AND BRIEF DESCRIPTION OF THE FIGURES

It is therefore one object of the present invention to provide a novel framing assembly for pictures, cards and the like wherein the mounting operations are greatly simplified.

Still another object of the present invention is to provide a novel framing assembly for pictures and the like wherein the framing and mounting operations are highly simplified.

Still another object of the present invention is to provide a novel framing assembly for photographs, pictures, graphic and printed matter and the like wherein the framing member is comprised of a transparent sheet having a frame, an adhesive layer forming a border on said framing member and being coextensive with said frame to facilitate framing and mounting of pictures.

Still another object of the present invention is to provide a novel framing assembly comprising a transparent frame sheet and a releasable transparent protective sheet to facilitate the framing operation.

Another object of the invention is to provide a framing sheet of the character described in which plural graphic matter may be displayed in a back-to-back manner.

The above as well as other objects of the present invention will become apparent when reading the accompanying description and drawing, in which:

FIG. 1 is a plan view of the framing assembly embodying principles of the present invention.

FIG. 2 shows a rear view of the framing assembly of FIG. 1 with the release sheet removed.

FIGS. 3 and 3A are sectional views of alternative embodiments of the framing assembly of FIG. 1 looking in the direction of arrows 3—3'.

FIG. 4 shows the framing assembly of FIG. 1 positioned upon a picture and to facilitate an understanding of the method and apparatus of the invention.

Figures 5, 6, 7, 7A:
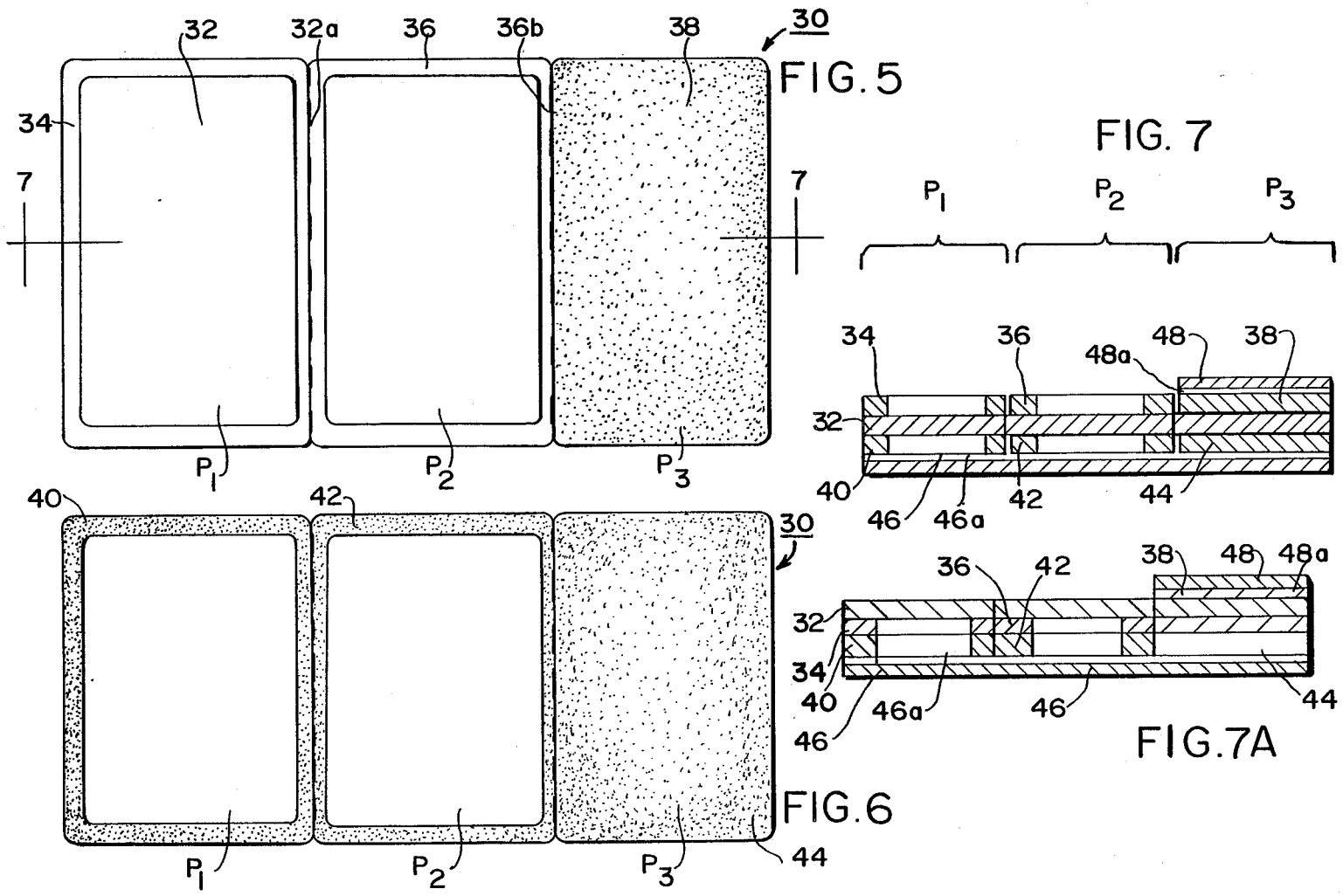
FIGS. 5 and 6 show front and rear plan views of another preferred embodiment of the present invention.
FIGS. 7 and 7A show sectional views of alternative arrangements of the embodiment of FIG. 5 looking in the direction of arrows 7—7' in FIG. 5.
Figure 8:
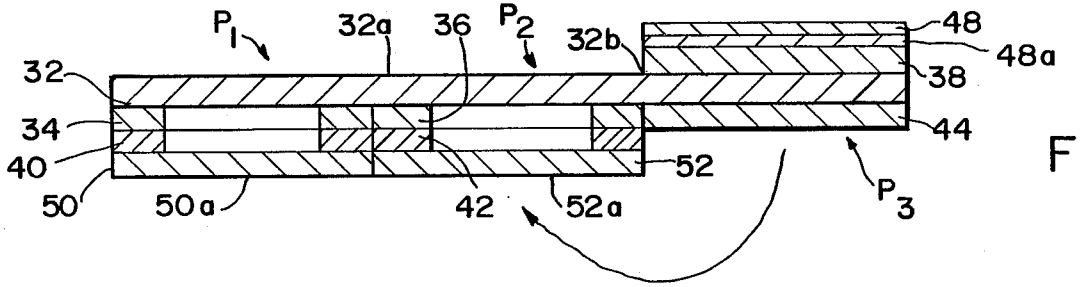
Figure 9:
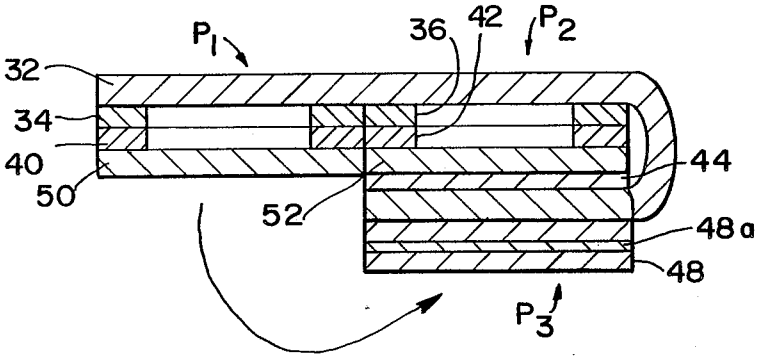
Figure 10:
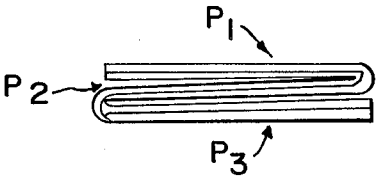

FIGS. 8—10 show end views of the embodiment of FIG. 5 and which are useful in describing the manner of use of said embodiment.

DETAILED DESCRIPTION OF THE INVENTION AND PREFERRED EMBODIMENTS THEREOF

The framing assembly 10 of the present invention is shown in FIGS. 1 through 3A and is comprised of a flexible transparent plastic sheet 12 formed of a suitable plastic material such as a natural or synthetic polymer of known type which provides excellent transparency to facilitate viewing of a picture or other graphic material affixed thereto. If desired, sheet 12 may be tinted, roughened (i.e. have a matte finish) or modified in some specific manner to obtain a desired visual affect. For example, the sheet maybe embossed to provide a texture.

A decorative frame 14 is printed upon the framing sheet 12. The frame or border 14 is preferably a suitable printing ink or paint or maybe a suitable plastic material of extremely thin gauge. The frame is preferably opaque but maybe somewhat translucent if desired. The frame may be of any color to enhance the aesthetic appearance of the framing sheet. The frame is preferably printed upon sheet 12 employing a silk-screening process, for example. The frame thus effectively contributes no additional thickness to sheet 12 to provide a thin lamination. The frame 14 is also protected from being damaged or scratched when placed on the lower surface of sheet 12 as shown in FIG. 3. The frame 14 may be formed on the underside of sheet 12 as shown in FIG. 3 or alternatively may be formed on the top side of sheet 12 as shown in FIG. 3A. The transparent sheet is formed of a suitable plastic material and is of a gauge chosen so that the thickness and toughness of the plastic material cooperate to prevent the framing sheet from being cut by a cutting instrument for an advantageous purpose to be more fully described.

The bottom surface of the transparent framing sheet 12 is provided with a frame-shaped adhesive layer 16 formed of a suitable pressure sensitive adhesive which may be any suitable adhesive composition which is tacky or sticky to the touch. Suitable adhesives are readily available and are well known to those skilled in the art of laminating clear plastic sheets utilizing release sheets. The adhesive may be deposited upon sheet 12 using a silk-screen technique. The frame-shaped adhesive layer 16 is preferably coextensive with the decorative frame 14. The outer perimeter of the adhesive layer 16 is contignuous with the outer perimeter of sheet 12 and the inner perimeter of adhesive layer 16 is contignuous with the inner layer of the decorative border 14. In the example shown in FIG. 3, the adhesive layer 16 is formed directly upon the decorative frame 14 whereas in the embodiment shown in FIG. 3A, the adhesive layer 16 and decorative border 14 are on opposing major surfaces of transparent sheet 12. The adhesive may be permanent or repositionable and thereby permit the mounted picture to be removed and replaced by another.

A release sheet 18 having the same shape and dimensions as transparent framing sheet 12 is provided with a suitable surface or layer of a release agent **18*a* to facilitate removal of the release sheet 18 from framing sheet 12. The release sheet 18 is preferably formed of a thin gauge plastic material. The release agent greatly facilitates peeling away of the release sheet 18 from the transparent framing sheet 12** during the performances of the mounting operation which will now be described:

The fully assembled framing assembly shown, for example, in FIG. 3 or 3A, is placed upon a sheet 20 which may, for example, have a picture (or any other graphic material) provided thereon. The framing assembly 10 is placed upon the picture as shown in FIG. 4 and is moved to any desired position to "crop" the picture, i.e. until the user is satisfied that the frame surrounds that portion of the picture which is desired to be mounted to the frame assembly. Assuming that the desired position is as shown in FIG. 4, the user then removes the release sheet, presses the picture against the exposed adhesive and thereafter cuts the picture using the framing assembly 10 as a template or guide. If desired the framing assembly may be used as a template whereby the perimeter of the assembly 10 is traced onto the sheet 20 by using a pen or pencil, for example, and then cut before being mounted to the frame. The gauge and ruggedness of the sheet 12 prevents the sheet from being easily cut either by a scissors or cutting edge such as a blade, for example, thus greatly simplifying the preparation of the picture in that the user need not be concerned about damaging the framing sheet 12. In one preferred embodiment the framing sheet 12 is formed of a clear polished vinyl of 20 mils thickness.

In the latter example, once the desired portion of the large picture on sheet 20 has been cut out, the release sheet is peeled away from the transparent framing sheet and the picture is placed against the surface of the transparent framing sheet containing the pressure sensitive adhesive layer. The picture and framing sheet are pressed together to form a satisfactory lamination. The decorative frame 14 not only serves to enhance the completed assembly but also serves to conceal any jagged or uneven edge along the photograph which may have been caused due to the manual cutting operation. The user need not be concerned with making a precision cut since the frame 14 serves to adequately conceal such a jagged edge or edges. The transparent framing sheet 12 serves to provide excellent viewing of the picture mounted thereto due to its excellent transparency characteristics as well as being totally devoid of an adhesive layer in the viewing region bordered by frame 14. In addition, the absence of any adhesive layer does not contribute to a deterioration in the viewing capability due to deterioration of the adhesive layer as a result of aging and exposure to sun and heat, as well as the diminished transparent quality of the framing sheet due to the presence of an adhesive layer in the view area.

The adhesive layer greatly facilitates mounting of the picture to the transparent frame sheet while nevertheless providing a sufficient amount of adhesive surface area to provide a good lamination between the picture and framing sheet 12.

The release sheet need not have excellent transparency and need only be sufficiently transparent to select or "crop" that portion of a picture or other graphic presentation to facilitate selection of the desired portion.

As a further alternative, the release sheet 18 may be translucent or even opaque. In such an embodiment, the framing assembly may be placed upon the surface of sheet 20 (see FIG. 4) so that the exposed surface of transparent framing sheet 12 engages the surface of sheet 20 containing the picture. The release sheet 18 may then be peeled away and the framing sheet may be moved about the surface of sheet 20 until the desired portion of the picture on sheet 20 is arranged within frame 14 by holding either the edge or the center portion of the framing sheet 12. The desired portion of the picture on sheet 20 may then be cut away from the sheet using the transparent framing sheet (absent the release sheet 18) as a template or as a cutting guide. It should be noted that sheet 12 may be held either at the edges or at the region surrounded by the adhesive border 16 during the cutting operation. The desired portion of the picture may then be joined to the framing sheet 12 in the same manner as described hereinabove.

FIGS. 5 through 7A show another preferred embodiment of the present invention in which a transparent sheet 32 is scored or perforated along score lines 32*a*, 32*b* to form three separate panels including framing panels P1 and P2 and a third panel P3 for adhering the framing panels to one another to form an assembly containing "back-to-back" photos or other graphic materials. FIG. 5 shows a front view of the novel panel assembly which is formed of a suitable plastic material such as, for example, a polished vinyl which is preferably of the order of four to six mils thick. Panels P1 and P2 are respectively provided with printed frames 34, 36 which, in the embodiment of FIG. 7 may be printed on the upper or outer surface or alternatively as shown in FIG. 7A may be printed upon the bottom or inner surface.

The upper surface of panel P3 contains a layer 38 of a suitable adhesive.

FIG. 6 shows the opposite or rear major surface of the panel assembly 30 which is provided with border like adhesive layers 40 and 42 which are coextensive with their associated frames 34, 36 such that frame 34 and adhesive border 40 frame a viewing area and such that frame 36 and adhesive border 42 frame a second viewing area. The panel P3 is provided with a layer 44 of a suitable pressure sensitive adhesive.

As shown in FIGS. 7 and 7A the printed frames 34, 36 may be printed either on the exterior surface or on the under surface, respectively. In the embodiment shown in FIG. 7A, the adhesive layers 40 and 42 are printed directly upon the frames 34, 36, respectively.

Considering the embodiment of FIG. 7, a release sheet 46 covers all three panels P1, P2 and P3 and has its release surface 46*a* in engagement with adhesive layers 40, 42 and 44. The arrangement in FIG. 7*a* is substantially identical in that release surface 46*a* is in surface contact with the adhesive layers 40, 42 and 44.

The adhesive layer 38 is covered by an additional release sheet 48 having its release surface 48*a* in contact with adhesive layer 38. The release sheets 46 and 48 are preferably transparent and are of an extremely thin gauge, especially when compared with the thickness of the flexible transparent sheet 32.

The manner of use of the "back-to-back" assembly of FIGS. 5 through 7A is as follows:

FIG. 10 shows the "back-to-back" assembly 30 folded preparatory to use. Since the flexible sheet 32 and the release sheets 46 and 48 are transparent, the package 30, folded in the manner shown in FIG. 10, may be placed upon a sheet 20 in the same manner as the framing assembly 10 shown in FIG. 4. The assembly 30 is moved about sheet 20 until the desired graphic matter is suitably "cropped", at which time assembly 30 may be utilized either as a template or a cutting guide in the same manner as was described for the embodiment of FIG. 1. A second area of sheet 20 may be selected for mounting to the assembly 30 in a similiar fashion or alternatively the second item of graphic material to be mounted may be selected from a second sheet or from any other suitable source. After the sheets contianing the graphic matter to be mounted have been prepared and cut to size, release sheet 46 is peeled away from the first panel P1 to permit the first sheet of graphic material to be mounted thereto. The mounting of the sheet containing the graphic material is performed in the same manner as was described hereinabove for the embodiment shown in FIGS. 1 through 3. The release sheet 46 is then peeled away from panel P2 and the second sheet of graphic material is mounted in a similiar fashion.

The release sheet 46 is then peeled away from panel P3 yielding the arrangement shown in FIG. 8 wherein the sheets 50 and 52 containing the desired graphic material are mounted to the adhesive borders of panels P1 and P2. At this time, panel P3 is swung about the score line or perforation 32*b* which serves as a hinged connection between panels P2 and P3, to move panel P3 to the position shown in FIG. 9 so that its adhesive surface 44 engages the surface 52*a* of sheet 52 which may, for example, be the back surface of a photograph. Thereafter, release sheet 48 is peeled away from adhesive layer 38 and panel P1 is moved in the direction shown by the arrow in FIG. 9 so as to swing about the hinged connection created by the score line or perforations 32*a* in order to move the panel P1 into a position substantially parallel to panel P3 in order to press the back side 50*a* of sheet 50 into intimate engagement with the adhesive layer 38 thereby forming a compact assembly containing two pictures, for example, arranged in "back-to-back" fashion. In the preferred embodiment, the flexible transparent plastic sheet 32 may lie in the range of from four to six mils thickness. Thus, a completed structure is of the order of twenty mils thick, assuming that the sheets 50 and 52 forming an integral part of the assembly have a thickness of the order of one mil and assuming that the thickness of the printed frames and the adhesive layers are negligible.

If desired, the adhesive may be subsequently peeled apart, the sheets 50 and 52 may be removed and new sheets may be inserted whereby the adhesive is sufficiently tacky to firmly hold the entire assembly together and having newly inserted sheets containing graphic matter or the like. This replaceability is also the case for the embodiment of FIG. 1.

The release sheet 46 may, if desired, be three separate release sheets, separated from one another along cut or score lines which are colinear with the score lines 32*a* and 32*b*. As another alternative, the release sheet 46 may be translucent or opaque whereby the framing assembly may be utilized to "crop" a picture or other graphic matter by removing the nontransparent release sheet and holding either the panel P2 or the panel P3 or both, which are still covered by their respective release sheets. Since panels P1 and P2 are substantially identical in size, the panel P1 maybe utilized to "crop" both the sheets to be mounted to the respective panels.

It can be seen from the foregoing that the present invention provides a unique framing assembly of simplified design which greatly facilitates both framing and mounting of the desired printed or graphic matter with an ease and simplicity not heretofore capable of being obtained in present day frame designs.

A latitude of modifications, change and substitution is intended in the foregoing disclosure, and in some instances, some features of the invention will be employed without a corresponding use of other features, Accordingly, it is appropriate that the appended claims be construed broadly and in a manner consistent with the spirit and scope of the invention herein described.

What is claimed is:

1. A framing assembly comprising:

a single unitary, substantially flat transparent flexible sheet;

framing means formed on said flexible sheet about the perimeter thereof and defining a framed viewing area surrounded by said framing means;

an adhesive layer arranged on one face of said flexible sheet and being substantially coextensive with said framing means so as to similarly frame said viewing area which is the devoid of any adhesive;

a unitary, single release sheet having a release surface, said release sheet covering the entire surface of said flexible sheet containing said adhesive layer with said release surface engaging the surface of said flexible sheet having the adhesive layer and being releasably secured to said adhesive layer to protect both the adhesive layer and the viewing area framed by said adhesive layer preparatory to use of the flexible sheet and being adapted to be completely peeled away from said transparent flexible sheet in one piece preparatory to mounting a graphic sheet thereon.

2. The framing assembly of claim 1 wherein said framing means comprises a printed frame of a color contrasting with said flexible sheet.

3. The framing assembly of claim 1 wherein said framing means and said adhesive layer are formed upon the same surface of said flexible sheet.

4. The framing assembly of claim 1 wherein said framing means and said adhesive layer are formed on opposing surfaces of said flexible sheet.

5. The framing assembly of claim 1 wherein said release sheet is provided with a release agent on one face thereof to facilitate removal of the release sheet from the adhesive bearing surface of the flexible sheet.

6. The framing assembly of claim 1 wherein said framing means is opaque.

7. The framing assembly of claim 1 wherein the thickness of said release sheet is of a gauge which is considerably less than that of said flexible sheet to facilitate peeling away of the releasable sheet from said flexible sheet.

8. A framing assembly comprising:

a transparent flexible sheet;

framing means secured to said flexible sheet about the perimeter thereof and defining a framed viewing area surrounded by said framing means;

an adhesive layer arranged on one face of said flexible sheet and being substantially coextensive with said framing means so as to similarly frame said viewing area which is the devoid of any adhesive;

a release sheet having a release surface, said release sheet covering the surface of said flexible sheet containing said adhesive layer with said release surface engaging the surface of said flexible sheet having the adhesive layer and being releasably secured to said adhesive layer to protect the adhesive layer and the viewing area framed by said adhesive layer preparatory to use of the flexible sheet; and said release sheet being sufficiently transparent to permit viewing of graphic material therethrough to facilitate selection of the desired graphic matter from a sheet which is larger in size than said flexible sheet by movement of the framing assembly upon the surface of the sheet containing the graphic matter.

9. A framing assembly comprising:

a transparent flexible sheet;

framing means secured to said flexible sheet about the perimeter thereof and defining a framed viewing area surrounded by said framing means;

an adhesive layer arranged on one face of said flexible sheet and being substantially coextensive with said framing means so as to similarly frame said viewing area which is the devoid of any adhesive;

a release sheet having a release surface, said release sheet covering the surface of said flexible sheet containing said adhesive layer with said release surface engaging the surface of said flexible sheet having the adhesive layer and being releasably secured to said adhesive layer to protect the adhesive layer and the viewing area framed by said adhesive layer preparatory to use of the flexible sheet; and said flexible sheet being of a gauge sufficient to prevent the flexible sheet from being cut with a scissor or other cutting instrument when the flexible sheet is utilized as a guide for cutting out a portion *8a* sheet containing the graphic matter.

10. A process for framing and mounting a portion of a sheet containing graphic matter comprising the steps of:

(a) moving a framing assembly comprising a flexible transparent sheet having framing means about its perimeter, said framing means framing a viewing area surrounded by said framing means, an adhesive layer on said flexible sheet being coextensive with said framing means and a transparent release sheet covering said flexible sheet and being adhered to said adhesive layer, said framing assembly being moved about a sheet containing the graphic matter to be formed;

(b) viewing the graphic matter bounded by said framing means through said flexible sheet and said release sheet and halting the movement of the framing assembly upon said sheet containing the graphic matter when that portion of the graphic matter to be mounted to the framing assembly is coextensive with said viewing area;

(c) cutting the desired portion of the sheet containing the graphic matter away from said sheet utilizing the framing assembly as a guide;

(d) peeling away the release sheet from said flexible sheet;

(e) aligning the cut-away portion of the sheet containing the desired graphic matter with the flexible sheet so that the desired graphic matter may be viewed through said flexible sheet;

and pressing the cut-away portion of said sheet against said flexible sheet to assure good adherence between the graphic matter bearing sheet and said flexible sheet.

11. A process for mounting a sheet containing graphic matter comprising the steps of:

(a) providing a framing assembly comprised of a flexible transparent sheet having framing means arranged about the marginal portion of said flexible sheet and bounding a framed viewing area; an adhesive layer arranged on one face of said flexible sheet, said adhesive layer being frame-shaped and substantially coextensive with said framing means, and a release sheet covering said flexible sheet and having a release surface engaging said flexible sheet and said adhesive layer;

(b) removing said release sheet from said framing assembly;

(c) placing the surface of said flexible sheet opposite that surface having the adhesive layer upon the sheet having the graphic matter;

(d) moving said flexible sheet upon the sheet having the graphic matter while viewing the sheet having graphic matter through the viewing area bounded by said framing means to move said flexible sheet to a location which the desired graphic matter is exposed through said viewing area;

(e) cutting that portion of the sheet containing the desired graphic matter away from the remaining portion of the sheet using the flexible sheet as a guide;

(f) aligning the portion of the sheet containing the desired graphic matter against said flexible sheet with the surface of the sheet containing the desired graphic matter engaging the surface of the flexible sheet containing said adhesive layer; and (g) pressing the sheet containing the desired graphic matter against the flexible sheet to assure good adherence with said adhesive layer.

12. A framing assembly comprising:

a single unitary, substantially flat transparent flexible sheet;

framing means formed on said flexible sheet about the perimeter thereof and defining a plurality of framed viewing areas surrounded by said framing means;

an adhesive layer arranged on one face of said flexible sheet and being substantially coextensive with said framing means so as to similarly frame said viewing areas which are devoid of any adhesive;

a single, unitary release sheet having a release surface, said release sheet covering the entire surface of said flexible sheet containing said adhesive layer with said release surface engaging the surface of said flexible sheet having the adhesive layer and being releasably secured to said adhesive layer to protect both the adhesive layer and the viewing area framed by said adhesive layer preparatory to use of the flexible sheet and exposing the entire adhesive areas and viewing areas when removed in one piece to facilitate mounting of graphic matter thereon.

13. The framing assembly of claim 12 wherein said flexible sheet is provided with means for folding said sheet into a plurality of panels, at least two of said panels being provided with said framing means to define a frame viewing area whereby said panels may be brought into back-to-back alignment.

14. The framing assembly of claim 13 wherein said flexible sheet is divided into three panels, said third panel being foldable into a position between said back-to-back panels.

15. The framing assembly of claim 12 wherein said release sheet is provided with a release agent on one face thereof to facilitate removal of the release sheet from the adhesive bearing surface of the flexible test.

16. The framing assembly of claim 12 wherein said release sheet is of a gauge which is considerably less than that of said flexible sheet to facilitate peeling away of the release sheet from the flexible sheet.

17. A framing assembly comprising:

a transparent flexible sheet;

framing means secured to said flexible sheet about the perimeter thereof and defining a plurality of framed viewing areas surrounded by said framing means;

an adhesive layer arranged on one face of said flexible sheet and being substantially coextensive with said framing means so as to similarly frame said viewing areas which are devoid of any adhesive;

a release sheet having a release surface, said release sheet covering the entire surface of said flexible sheet containing said adhesive layer with said release surface engaging the surface of said flexible sheet having the adhesive layer and being releasable secured to said adhesive layer to protect the adhesive layer and the viewing areas framed by said adhesive layer preparatory to use of the flexible sheet;

said flexible sheet being provided with means for folding said sheet into a plurality of panels, at least two of said panels each being provided with said framing means to define a framed viewing area whereby said panels may be brought into back-to-back alignment;

said flexible sheet being divided into three panels, said third panel being foldable into a position between said back-to-back panels;

the opposite surfaces of said third panel each being provided with an adhesive layer; and said first-mentioned release sheet being of a size sufficient to cover the common surfaces of said first, second and third panels.

18. The framing assembly of claim 17 further comprising an additional release sheet for covering the adhesive layer on the remaining surface of said third panel.

19. The framing assembly of claim 18 wherein said first-mentioned release sheet is divided into three separate release sheets each covering one of said associated panels and each being separately removable from its associated panel independently of the remaining separate release sheets.

20. The framing assembly of claim 19 wherein said panels are substantially equal in size and said panels are foldable along said folds means into a compact arrangement in which the thickness of said arrangement is substantially equal to at least three times the thickness of said sheet and wherein the surface area of said arrangement is substantially equal to the size of one of said panels.

21. A framing assembly comprising:

a transparent flexible sheet;

framing means secured to said flexible sheet about the perimeter thereof and defining a plurality of framed viewing areas surrounded by said framing means;

an adhesive layer arranged on one face of said flexible sheet and being substantially coextensive with said framing means so as to similarly frame said viewing areas which are devoid of any adhesive;

a release sheet having a release surface, said release sheet covering the entire surface of said flexible sheet containing said adhesive layer with said release surface engaging the surface of said flexible sheet having the adhesive layer and being releasably secured to said adhesive layer to protect the adhesive layer and the viewing area framed by said adhesive layer preparatory to use of the flexible sheet; and said release sheet being sufficiently transparent to permit viewing of graphic matter therethrough to facilitate selection of the desired graphic matter from a sheet by movement of at least one of the viewing areas upon the surface of the sheet containing the graphic matter.

22. A process for mounting a sheet containing graphic matter comprising the steps of:

(a) providing a framing assembly comprised of a flexible transparent sheet having framing means arranged about marginal portions of said flexible sheet and defining two framed viewing areas; an adhesive layer arranged on one face of said flexible sheet said adhesive layer being substantially coextensive with said framing means, said flexible sheet being provided with fold lines for folding said flexible sheet into three panels of substantially equal size, said first and second panels containing said framing means and said third panel being provided with an adhesive layer on each of its opposing surfaces; and release sheet means covering all of said adhesive layers and having a release surface engaging said flexible sheet and said adhesive layers;

(b) moving said flexible sheet upon the sheet containing the graphic matter while viewing the graphic matter through one of said viewing areas, said flexible sheet being moved to a location at which the desired graphic matter is exposed in said viewing area;

(c) cutting the portions of the sheet containing the desired graphic matter away from the remaining portion of the sheet using at least one of the panels of the flexible sheet as a guide;

(d) peeling the release sheet means away from a first one of the panels incorporating one of said viewing areas;

(e) aligning the portion of the sheet containing the desired graphic matter against the now exposed surface of the panel whereby the surface of the sheet containing the desired graphic matter engages a surface of the flexible sheet containing the adhesive layer framing the viewing area;

(f) pressing the sheet containing the desired graphic matter against the flexible sheet to assure good adherence with said adhesive layer.

23. The process of claim 22 further comprising the steps of:

(g) repeating steps (b) and (c) to obtain a second sheet of graphic matter;

(h) aligning the portion of the second sheet containing the desired graphic matter against said second panel with the surface of the sheet containing the desired graphic matter engaging the surface of the flexible sheet panel containing said adhesive layers;

(i) pressing the second sheet containing the desired graphic matter against the flexible sheet to assure good adherence with said adhesive layer.

24. The process of claim 23 further comprising the steps of:

(j) removing the release sheet means covering one surface of said third panel;

(k) folding said third panel along its associated fold line so that it firmly adheres to the back surface of the sheet containing the graphic matter which has been adhered to the second panel which is integral with said third panel;

(l) peeling the remaining release sheet means away from said third panel; and (m) moving said first panel into engagement with the exposed surface of said third panel to form a compact assembly in which the graphic matter exposed through said viewing areas are arranged in back-to-back fashion.

25. A process for framing and mounting a portion of a sheet containing graphic matter comprising the steps of:

(a) moving a framing assembly comprising a flexible transparent sheet having framing means about its perimeter, said framing means framing a viewing area surrounded by said framing means, an adhesive layer on said flexible sheet being coextensive with said framing means and a transparent release sheet covering said flexible sheet and being adhered to said adhesive layer, said framing assembly being moved about a sheet containing the graphic matter to be formed;

(b) viewing the graphic matter bounded by said framing means through said flexible sheet and said release sheet and halting the movement of the framing assembly upon said sheet containing the graphic matter when that portion of the graphic matter to be mounted to the framing assembly is coextensive with said viewing area;

(c) peeling away the release sheet from said flexible sheet;

(d) aligning the portion of the sheet containing the desired graphic matter with the flexible sheet so that the desired graphic matter may be viewed through said flexible sheet;

(e) pressing the cut-away portion of said sheet against said flexible sheet to assure good adherence between the graphic material bearing sheet and said flexible sheet;

(f) cutting the desired portion of the sheet containing the graphic matter away from said sheet utilizing the framing assembly as a guide;

26. A process for mounting a sheet containing graphic matter comprising the steps of:

(a) providing a framing assembly comprised of a flexible transparent sheet having framing means arranged about marginal portions of said flexible sheet and defining two framed viewing areas; an adhesive layer arranged on one face of said flexible sheet said adhesive layer being substantially coextensive with said framing means, said flexible sheet being provided with fold lines for folding said flexible sheet into three panels of substantially equal size, said first and second panels containing said framing means and said third panel being provided with an adhesive layer on each of its opposing surfaces; and release sheet means covering all of said adhesive layers and having a release surface engaging said flexible sheet and said adhesive layers;

(b) moving said flexible sheet upon the sheet containing the graphic matter while viewing the graphic matter through one of said viewing areas, said flexible sheet being moved to a location at which the desired graphic matter is exposed in said viewing area;

(c) peeling the release sheet means away from a first one of the panels incorporating one of said viewing areas;

(d) aligning the portion of the sheet containing the desired graphic matter against the now exposed surface of the panel whereby the surface of the sheet containing the desired graphic matter engages a surface of the flexible sheet containing the adhesive layer framing the viewing area;

(e) pressing the sheet containing the desired graphic matter against the flexible sheet to assure good adherence with said adhesive layer; and (f) cutting the portions of the sheet containing the desired graphic matter away from the remaining portion of the sheet using at least one of the panels of the flexible sheet as a guide.

27. The process of claim 26 further comprising the steps of:

(g) repeating steps (b) and (c) to obtain a second sheet of graphic matter;

(h) aligning the portion of the second sheet containing the desired graphic matter against said second panel with the surface of the sheet containing the desired graphic matter engaging the surface of the flexible sheet panel containing said adhesive layers;

(i) pressing the second sheet containing the desired graphic matter against the flexible sheet to assure good adherence with said adhesive layer; and (j) cutting the portions of the sheet containing the desired graphic matter away from the remaining portion of the sheet using at least one of the panels of the flexible sheet as a guide;

28. The process of claim 27 further comprising the steps of:

(k) removing the release sheet means covering one surface of said third panel;

(l) folding said third panel along its associated fold line so that it firmly adheres to the back surface of the sheet containing the graphic matter which has been adhered to the second panel which is integral with said third panel;

(m) peeling the remaining release sheet means away from said third panel; and (n) moving said first panel into engagement with the exposed surface of said third panel to form a compact assembly in which the graphic matter exposed through said viewing areas are arranged in back-to-back fashion.

* * * * *

UNITED STATES PATENT AND TRADEMARK OFFICE

CERTIFICATE OF CORRECTION

PATENT NO. : 4,914,842

DATED : April 10, 1990

INVENTOR(S) : Aaron Lieberman

It is certified that error appears in the above-identified patent and that said Letters Patent is hereby corrected as shown below:

Column 3, line 45, before "principles" insert --the--

Column 4, line 41, "contignuous" should be --contiguous--

Column 4, lines 42-43, "contignuous" should be --contiguous--

Column 4, line 59, "performances" should be --performance--

Column 9, line 20, "8a" should be --of a--

Column 10, line 39, "area" should be --areas--

Column 10, line 58, "test" should be --sheet--

Column 13, line 36, "guide;" should be --guide.--

Column 14, line 38, "guide;" should be --guide.--

Signed and Sealed this

First Day of October, 1991

*Attest:*

*Attesting Officer*

HARRY F. MANBECK, JR.

*Commissioner of Patents and Trademarks*